US010796635B2

(12) United States Patent
Qian et al.

(10) Patent No.: US 10,796,635 B2
(45) Date of Patent: Oct. 6, 2020

(54) PIXEL DRIVING CIRCUIT HAVING DUAL DRIVER UNIT, DRIVING METHOD FOR THE SAME AND DISPLAY PANEL

(71) Applicants: BOE TECHNOLOGY GROUP CO., LTD., Beijing (CN); Hefei Xinsheng Optoelectronics Technology Co., Ltd., Hefei, Anhui (CN)

(72) Inventors: Xianrui Qian, Beijing (CN); Yuting Chen, Beijing (CN); Zixuan Wang, Beijing (CN); Bo Li, Beijing (CN); Fei Li, Beijing (CN)

(73) Assignees: BOE TECHNOLOGY GROUP CO., LTD., Beijing (CN); Hefei Xinsheng Optoelectronics Technology Co., Ltd., Hefei, Anhui (CN)

( * ) Notice: Subject to any disclaimer, the term of this patent is extended or adjusted under 35 U.S.C. 154(b) by 0 days.

(21) Appl. No.: 16/152,263

(22) Filed: Oct. 4, 2018

(65) Prior Publication Data

US 2019/0172392 A1 Jun. 6, 2019

(30) Foreign Application Priority Data

Dec. 4, 2017 (CN) ..... 2017 1 1262899

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01);
(Continued)

(58) Field of Classification Search
CPC ..... G09G 3/3233; G09G 2320/0233; G09G 2320/0252; G09G 2310/0248;
(Continued)

(56) References Cited

U.S. PATENT DOCUMENTS

2015/0287361 A1* 10/2015 Lee ..... G09G 3/3233 315/172
2016/0253963 A1* 9/2016 Yang ..... G09G 3/3225 345/211

(Continued)

FOREIGN PATENT DOCUMENTS

CN 101937647 A 1/2011
CN 102656621 A 9/2012

(Continued)

OTHER PUBLICATIONS

Chinese Office Action dated Mar. 29, 2019, from application No. 201711262899.4.

*Primary Examiner* — Kwang-Su Yang
(74) *Attorney, Agent, or Firm* — Foley & Lardner LLP

(57) ABSTRACT

The present disclosure relates to a pixel driving circuit and a driving method for the same and a display panel. The pixel driving circuit includes a driver unit, a circuit switching unit, and a storage capacitor unit. The driver unit includes a first sub-driver unit and a second sub-driver unit. The circuit switching unit has a first switching unit and a second switching unit. Two terminals of the first switching unit are electrically connected to a first terminal of the light emitting unit and the first sub-driver unit, respectively, two terminals of the second switching unit are electrically connected to the light emitting unit and the second sub-driver unit, respectively, and the circuit switching unit is configured to switch conductive states of the first switching unit and the second switching unit.

12 Claims, 4 Drawing Sheets

(52) U.S. Cl.
CPC ..... *G09G 2300/0842* (2013.01); *G09G 2300/0861* (2013.01); *G09G 2300/0871* (2013.01); *G09G 2310/0248* (2013.01); *G09G 2310/0264* (2013.01); *G09G 2320/0233* (2013.01); *G09G 2320/0252* (2013.01); *G09G 2320/043* (2013.01); *G09G 2330/08* (2013.01)

(58) Field of Classification Search
CPC ... G09G 2310/0264; G09G 2300/0819; G09G 2300/0871
See application file for complete search history.

(56) References Cited

U.S. PATENT DOCUMENTS

| | | | | |
|---|---|---|---|---|
| 2017/0193910 | A1* | 7/2017 | Chen | G09G 3/325 |
| 2017/0263184 | A1* | 9/2017 | Chen | G09G 3/3266 |

FOREIGN PATENT DOCUMENTS

| | | | |
|---|---|---|---|
| CN | 103971640 | A | 8/2014 |
| CN | 106910459 | A | 6/2017 |

* cited by examiner

PIXEL DRIVING CIRCUIT HAVING DUAL DRIVER UNIT, DRIVING METHOD FOR THE SAME AND DISPLAY PANEL

CROSS-REFERENCE TO RELATED APPLICATIONS

This application claims priority to Chinese Patent Application 201711262899.4, filed Dec. 4, 2017, the entire contents of which are incorporated herein by reference.

TECHNICAL FIELD

The present disclosure relates to display technologies, and particularly to a pixel driving circuit and a driving method for the same, and a display panel.

BACKGROUND

Active-matrix organic light emitting diode (AMOLED) display devices has advantages such as thinness, lightness, active illumination (no backlight required), wide viewing angle, high definition, high brightness, fast response, low energy consumption, wide temperature range, strong shock resistance and flexible display and the like, and thus the AMOLED display devices have recently been widely applied.

The driver unit of an AMOLED display panel is driven by a driving part 2T1C. The 2T1C structure includes a switching thin film transistor (TFT) and a driver TFT. The driver TFT is in a working state most of the time. A series of defect states such as trap stages exist inside the TFT, and thus if the TFT is in the working state for a long term, the threshold voltage of the driver TFT will have a certain drift, which leads to an abnormal change in the output current of the driver TFT. The luminous intensity of the OLED driven by the driver TFT is directly related to the output current of the driver TFT. Therefore, under the long-term operation of the AMOLED display, the luminous intensity of the OLED is affected by the threshold voltage drift of the driver TFT, and the brightness of the AMOLED display is not stable enough.

SUMMARY

Arrangements of the present disclosure provide a pixel driving circuit and a driving method for the same, and a display panel.

According to an aspect of arrangements of the present disclosure, there is provided a pixel driving circuit including a driver unit, a circuit switching unit and a storage capacitor unit. The driver unit includes a first sub-driver unit and a second sub-driver unit. The circuit switching unit has a first switching unit and a second switching unit. Two terminals of the first switching unit are electrically connected to a first terminal of a light emitting unit and the first sub-driver unit, respectively. Two terminals of the second switching unit are electrically connected to the light emitting unit and the second sub-driver unit, respectively. The circuit switching unit is configured to switch conductive states of the first switching unit and the second switching unit.

The objectives and technical problems of the present disclosure can be achieved or solved by the following solutions.

According to an exemplary arrangement, the first sub-driver unit and the second sub-driver unit are thin film transistors.

According to an exemplary arrangement, the pixel driving circuit comprises a switching unit. The storage capacitor unit includes a first capacitor and a second capacitor. The switching unit includes a first data writing unit and a second data writing unit. The first data writing unit and a gate of the first sub-driver unit are connected via the first capacitor, and the second data writing unit and a gate of the second sub-driver unit are connected via the second capacitor.

According to an exemplary arrangement, the pixel driving circuit includes a data terminal connected to a first electrode of the first data writing unit and a first electrode of the second data writing unit. The pixel driving circuit includes a first control terminal connected to a gate of the first data writing unit. The pixel driving circuit includes a second control terminal connected to a gate of the second data writing unit. The pixel driving circuit includes a third control terminal connected to a gate of the first switching unit. The pixel driving circuit includes a fourth control terminal connected to a gate of the second switching unit. The pixel driving circuit includes a first level signal input terminal connected to a second terminal of the light emitting unit. The pixel driving circuit includes a second level signal input terminal connected to a first electrode of the first sub-driver unit and a first electrode of the second sub-driver unit. A second electrode of the first sub-driver unit is connected to a first electrode of the first switching unit. A second electrode of the second sub-driver unit is connected to a first electrode of the second switching unit, a second electrode of the first switching unit is connected to a first terminal of the light emitting unit. A second electrode of the second switching unit is connected to the first terminal of the light emitting unit.

According to an exemplary arrangement, the pixel driving circuit further includes a first charging unit and a first discharging unit. The first charging unit has a first charging switch, and two terminals of the first charging switch are connected to a charging circuit and a first terminal of the first capacitor, respectively. The first discharging unit has a first discharging switch, and two terminals of the first discharging switch are connected to a discharging circuit and a second terminal of the first capacitor.

According to an exemplary arrangement, a gate of the first charging unit is connected to the second control terminal. A first electrode of the first charging unit is connected to the first electrode of the first switching unit. A second electrode of the first charging unit is connected to the first terminal of the first capacitor. A gate of the first discharging unit is connected to the second control terminal. A first electrode of the first discharging unit is connected to a second terminal of the first capacitor. A second electrode of the first discharging unit is connected to a common ground.

According to an exemplary arrangement, the pixel driving circuit further includes a second charging unit and a second discharging unit. The second charging unit has a second charging switch, and two terminals of the second charging switch are connected to a charging circuit and a first terminal of the second capacitor, respectively. The second discharging unit has a second discharging switch, and two terminals of the second discharging switch are connected to a discharging circuit and a second terminal of the second capacitor.

According to an exemplary arrangement, a gate of the second charging unit is connected to the first control terminal. A first electrode of the second charging unit is connected to the first electrode of the second switching unit. A second electrode of the second charging unit is connected to a first terminal of the second capacitor. A gate of the second discharging unit is connected to the first control terminal. A first electrode of the second discharging unit is connected to a second terminal of the second capacitor. A second electrode of the second discharging unit is connected to a common ground.

According to an exemplary arrangement, the first sub-driver unit and the second sub-driver unit are P-type thin film transistors. A signal input to the first level signal input terminal is a high level signal, and a signal input to the second level signal input terminal is a low level signal.

According to another aspect of arrangements of the present disclosure, there is provided an array substrate, including the pixel driving circuit as described above.

According to another aspect of arrangements of the present disclosure, there is provided a display panel, including the array substrate as described above.

According to another aspect of arrangements of the present disclosure, there is provided a driving method for the pixel driving circuit as described above. The method includes, in a first writing stage, inputting a high level signal to the first control terminal to make the first data writing unit in a conductive state, and to transmit a data signal at the data terminal to the first capacitor. The method includes, in a first driving stage, inputting a high level signal to the third control terminal to make the first switching unit in a conductive state, inputting a low high level signal to the fourth control terminal to make the second switching unit in a non-conductive state, and driving the light emitting unit to emit light by the first sub-driver unit. The method includes, in a second writing stage, inputting a high level signal to the second control terminal to make the second data writing unit in a conductive state, and to transmit the data signal at the data terminal to the second capacitor. The method includes, in a second driving stage, inputting a high level signal to the fourth control terminal to make the second switching unit in a conductive state, inputting a low level signal to the third control terminal to make the first switching unit in a non-conductive state, and driving the light emitting unit to emit light by the second sub-driver unit.

The objectives and technical problems of the present disclosure can be achieved or solved by the following solutions. According to an exemplary arrangement, the pixel driving circuit further includes a first charging unit and a first discharging unit. The first charging unit has a first charging switch, and two terminals of the first charging switch are connected to a charging circuit and a first terminal of the first capacitor, respectively. The first discharging unit has a first discharging switch, and two terminals of the first discharging switch are connected to a discharging circuit and a second terminal of the first capacitor. A gate of the first charging unit is connected to the second control terminal, a first electrode of the first charging unit is connected to the first electrode of the first switching unit, and a second electrode of the first charging unit is connected to the first terminal of the first capacitor. A gate of the first discharging unit is connected to the second control terminal, a first electrode of the first discharging unit is connected to a second terminal of the first capacitor, and a second electrode of the first discharging unit is connected to a common ground. In the second writing stage, the method further includes inputting a high level signal to the second control terminal, and at the same time inputting a high level signal to the third control terminal to make the first charging unit in a conductive state and the first discharging unit in a conductive state and to charge the first capacitor. The method further includes inputting a low level signal to the third control terminal to make the first switching unit in a non-conductive state to discharge the first capacitor until a voltage across the first and second terminals of the first capacitor is dropped to a threshold voltage of the first sub-driver unit. In the second driving stage, the method further includes inputting a low level signal to the second control terminal to make the first charging unit in a non-conductive state and the first discharging unit in a non-conductive state.

According to an exemplary arrangement, the pixel driver unit further includes a second charging unit and a second discharging unit. The second charging unit has a second charging switch, and two terminals of the second charging switch are connected to a charging circuit and a first terminal of the second capacitor, respectively. The second discharging unit has a second discharging switch, and two terminals of the second discharging switch are connected to a discharging circuit and a second terminal of the second capacitor. A gate of the second charging unit is connected to the first control terminal, a first electrode of the second charging unit is connected to the first electrode of the second switching unit, and a second electrode of the second charging unit is connected to a first terminal of the second capacitor.

A gate of the second discharging unit is connected to the first control terminal, a first electrode of the second discharging unit is connected to a second terminal of the second capacitor, and a second electrode of the second discharging unit is connected to a common ground. In the first writing stage, the method further includes inputting a high level signal to the first control terminal, and at the same time inputting a high level signal to the fourth control terminal to make the second charging unit in a conductive state. The second discharging unit is in a conductive state and the second switching unit is in a conductive state to charge the second capacitor. The method further includes inputting a low level signal to the fourth control terminal to make the second switching unit in a non-conductive state to discharge the second capacitor, until a voltage across first and second terminals of the second capacitor is dropped to a threshold voltage of the second sub-driver unit. In the first driving stage, the method further includes inputting a low level signal to the first control terminal to make the second charging unit in a non-conductive state and the second discharging unit in a non-conductive state.

According to an exemplary arrangement, the first writing stage, the first driving stage, the second writing stage and the second driving stage are performed sequentially and cyclically.

The technical solutions of the present disclosure have at least the following advantages.

In the technical solution provided by the arrangements of the present disclosure, the pixel driving circuit has a dual driver unit, that is, the first sub-driver unit and the second sub-driver unit can alternately drive the light emitting unit, which can reduce the time for a single driver unit to drive the light emitting unit as compared with the prior art. Thus, the present disclosure can reduce the drift in threshold voltage of each driver unit, and can improve the stability of the brightness of the light emitting unit.

The above description is only an overview of the technical solutions of the present disclosure, and the technical means of the present disclosure can be more clearly understood and can be implemented according to the contents of the specification. Hereinafter, the exemplary arrangements of the present disclosure will be described in detail with reference to the accompanying drawings.

BRIEF DESCRIPTION OF THE DRAWINGS

Various other advantages and benefits will become apparent to those skilled in the art from the detailed descriptions of the exemplary arrangements below. The drawings are only for the purpose of illustrating the exemplary arrangements and are not intended to be construed as limiting the present disclosure. Throughout the drawings, the same components are denoted by the same reference numerals. In the drawings.

DETAILED DESCRIPTION

In order to further explain the technical means and functions of the present disclosure for achieving the purpose of the present disclosure, the pixel driving circuit, the display panel and the driving method thereof provided by the present disclosure are specifically described below with reference to the accompanying drawings and exemplary arrangements. Structures, characteristics and technical effects of the arrangements will be described below. In the following description, "an arrangement" or "one arrangement" mentioned many places herein does not necessarily mean the same arrangement. Furthermore, the particular features, structures, or characteristics of one or more arrangements can be combined in any suitable form.

Arrangements of the present disclosure provided a pixel driving circuit which has a dual driver unit. That is two driver units are used to alternately drive the light emitting unit. The present disclosure can reduce the time for a single driver unit to drive the light emitting unit as compared with the prior art. Thus, the present disclosure can reduce the drift in threshold voltage of each driver unit, and can improve the stability of the brightness of the light emitting unit.

Figure 1:
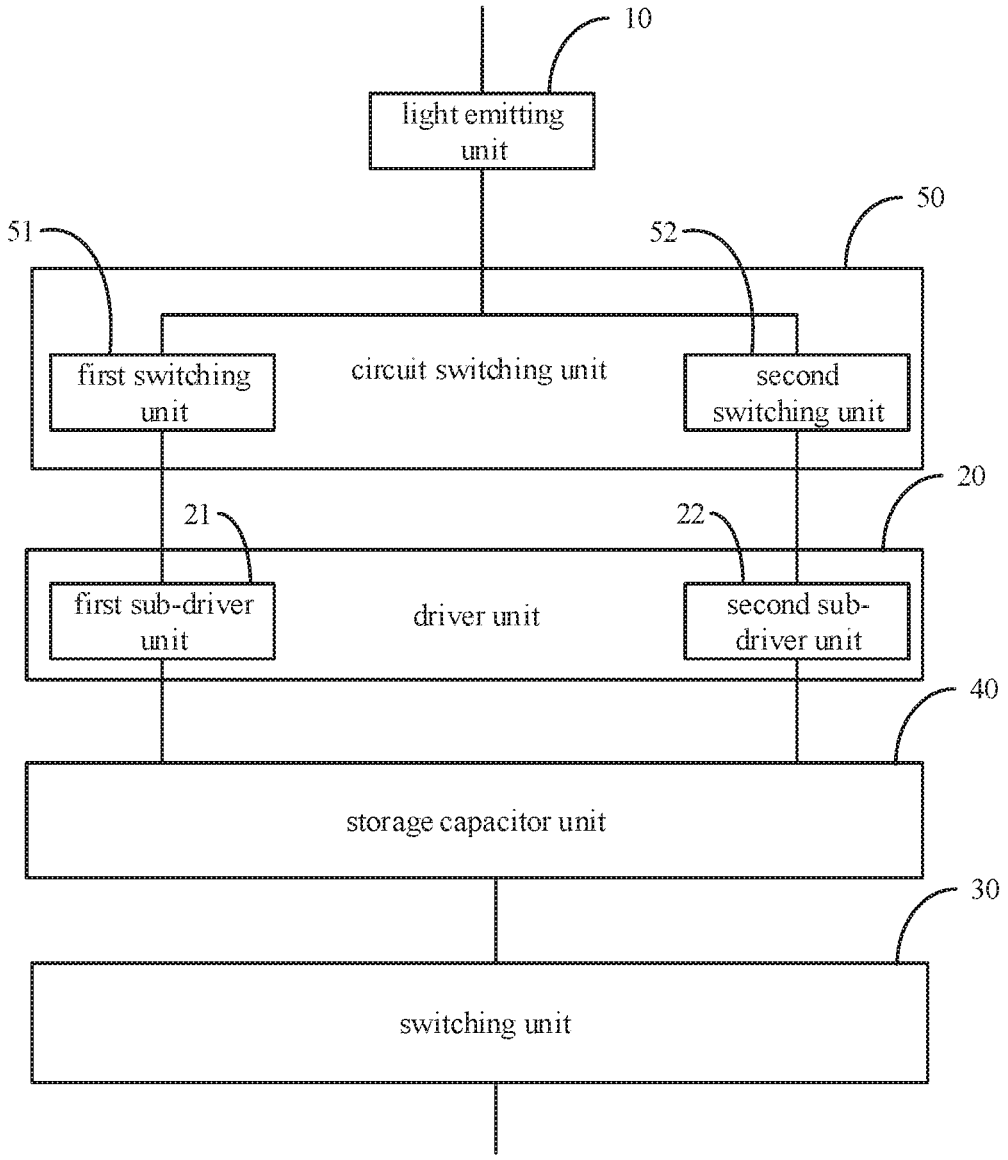
FIG. 1 is a schematic structural diagram of a pixel driving circuit according to an arrangement of the present disclosure.

FIG. 1 is a pixel driving circuit according to an arrangement of the present disclosure. Referring to FIG. 1, a pixel driving circuit according to an arrangement of the present disclosure is shown in FIG. 1. The pixel driving circuit includes a driver unit 20, a switching unit 30, a storage capacitor unit 40, and a circuit switching unit 50.

The driver unit 20 includes a first sub-driver unit 21 and a second sub-driver unit 22. The circuit switching unit 50 has a first switching unit 51 and a second switching unit 52. Two terminals of the first switching unit 51 are electrically connected to a first terminal of the light emitting unit 10 and the first sub-driver unit 21, respectively. Two terminals of the second switching unit 52 are electrically connected to the light emitting unit 10 and the second sub-driver unit 22, respectively. The circuit switching unit is configured to switch conductive states of the first switching unit 51 and the second switching unit 52. The circuit switching unit 50 can switch the first switching unit 51 to be in a conductive state (i.e., an on state) and control the second switching unit 52 to be in a non-conductive state (i.e., an off state) in a first period of time, so that the first sub-driver unit 21 drives the light emitting unit 10 to emit light. The circuit switching unit 50 can switch the second switching unit 52 to be in a conductive state and control the first switching unit 52 to be in a non-conductive state in a second period of time, so that the second sub-driver unit 22 drives the light emitting unit 10 to emit light.

The pixel driving circuit has a dual driver unit, that is, the first sub-driver unit and the second sub-driver unit can alternately drive the light emitting unit, which can reduce the time for a single driver unit to drive the light emitting unit as compared with the prior art. Thus, the present disclosure can reduce the drift in threshold voltage of each driver unit, and can improve the stability of the brightness of the light emitting unit.

Figure 2:
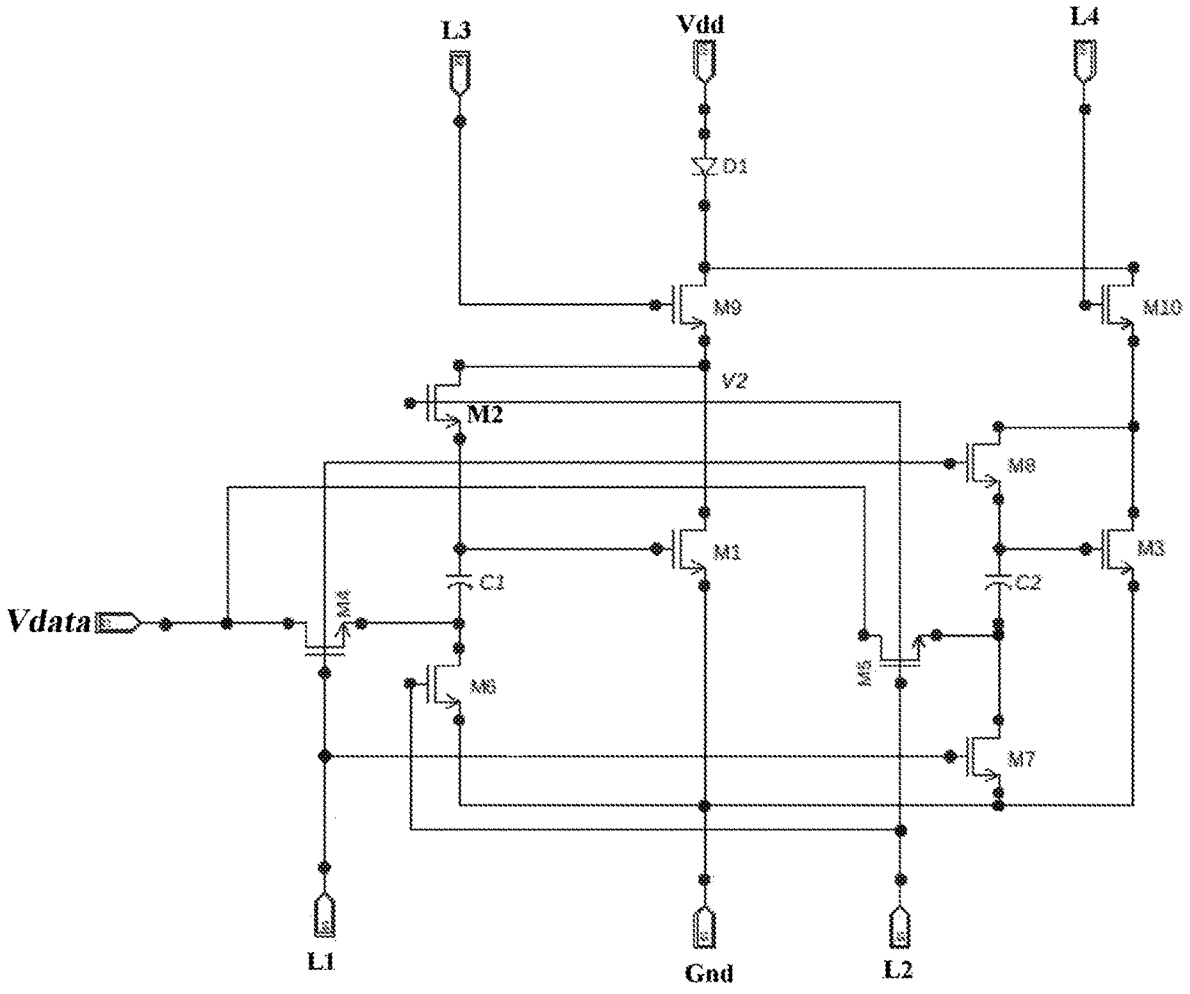
FIG. 2 is a schematic structural diagram of a specific implementation of a pixel driving circuit according to an arrangement of the present disclosure.

As shown in FIG. 2, the light emitting unit is an organic light emitting diode D 1. The light emitting unit includes a first terminal (or electrode) and a second terminal (or electrode), and a driving voltage is applied between the first electrode and the second electrode of the light emitting unit to drive the light emitting unit to emit light. The first sub-driver unit M1, the second sub-driver unit M3, the first switching unit M9, and the second switching unit M10 may each be a thin film transistor.

Figure 3:
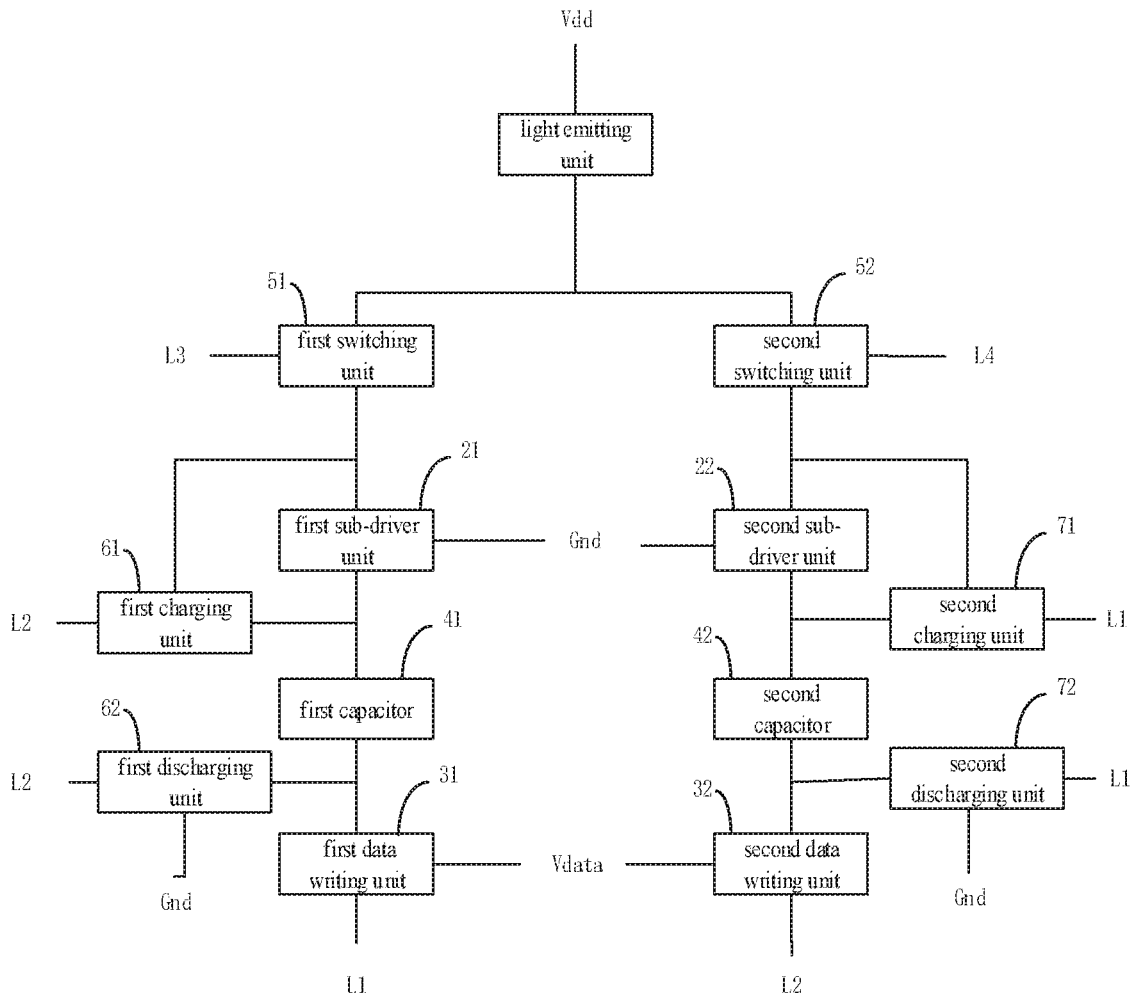
FIG. 3 is a schematic structural diagram of a pixel driving circuit according to an arrangement of the present disclosure.

FIG. 3 is a specific arrangement of the pixel driving circuit of the present disclosure. Referring to FIG. 3, the storage capacitor unit includes a first capacitor 41 and a second capacitor 42. The switching unit includes a first data writing unit 31 and a second data writing unit 32. The first data writing unit 31 and a gate of the first sub-driver unit 21 are connected via the first capacitor 41. That is, the two terminals of the first capacitor are connected to the first data writing unit 31 and the gate of the first sub-driver unit 21, respectively. The second data writing unit 32 and a gate of the second sub-driver unit 22 are connected via the second capacitor 42. That is, both terminals of the second capacitor are connected to the second data writing unit and the gate of the second sub-driver unit, respectively. In the driving, the first sub-driver unit is used to drive the light emitting unit.

For example, the first data driving signal is input to the first sub-driver unit by turning on the first data writing unit, and the first switching unit is turned on, so that the first sub-driver unit can drive the light emitting. If the second sub-driver unit is used to drive the light emitting unit, the second data writing unit is turned on, the data signal at the data terminal is input to the second sub-driver unit, and the second switching unit is turned on to implement the driving of the light emitting unit by the second sub-driver unit. Two controllable switches and two capacitors work alternately, so that the alternating driving of the light emitting unit by the two sub-driver units can be realized.

In the driving control of the pixel driving circuit, it is usually necessary to configure related signal lines, such as a data terminal Vdata, a first control terminal L1, a second control terminal L2, a third control terminal L3, a fourth control terminal L4, a first level signal input terminal Vdd, and a second level signal input terminal Gnd. The data terminal Vdata is connected to the first electrode of the first data writing unit 31 and the first electrode of the second data writing unit 32. The first control terminal L1 is connected to the gate of the first data writing unit 31. The second control terminal L2 is connected to the gate of the second data writing unit 32. The third control terminal L3 is connected to the gate of the first switching unit 51. The fourth control terminal L4 is connected to the gate of the second switching unit 52. The first level signal input terminal Vdd is connected to the second terminal of the light emitting unit. The second level signal input terminal Gnd is connected to the first electrode of the first sub-driver unit 21 and the first electrode of the second sub-driver unit 22. The second electrode of the sub-driver unit 21 is connected to the first electrode of the first switching unit 51, the second electrode of the second sub-driver unit 22 is connected to the first electrode of the second switching unit 52, and the second electrode of the first switching unit is connected to the first terminal of the light emitting unit, and the second electrode of the second switching unit 52 is connected to the first terminal of the light emitting unit.

The data signal outputted by the data terminal can be used to control the brightness of the light emitting unit. The high level and low level signals output by the first control terminal are used to control the conductive state and the non-conductive state of the first data writing unit, respectively. The high level and low level signals outputted by the second control terminal are used to control the conductive state and the non-conductive state of the second data writing unit, respectively. The high level and low level signals outputted by the third control terminal are used to control the conductive state and the non-conductive state of the first switching unit, respectively. The high level and low level signals output by the fourth control terminal are used to control the conductive state and the non-conductive state of the second switching unit, respectively. When the first sub-driver unit and the second sub-driver unit are P-type thin film transistors, the first level signal input terminal may be a power supply VDD, and the second level signal input terminal may be a common ground GND. It is easy to understand that the first sub-driver unit and the second sub-driver unit are not limited to P-type thin film transistors, and N-type thin film transistors can also be used. As shown in FIG. 2, the first data writing unit M4 and the second data writing unit M5 may each be a thin film transistor.

Based on the pixel driving circuit in the above arrangement, the present disclosure provides a driving method for the pixel driving circuit. Two sub-driver units can alternately drive the light emitting unit, which can reduce the time for a single driver unit to drive the light emitting unit as compared with the prior art. Thus, the present disclosure can reduce the drift in threshold voltage of each driver unit, and can thus improve the stability of the brightness of the light emitting unit.

Figure 4:
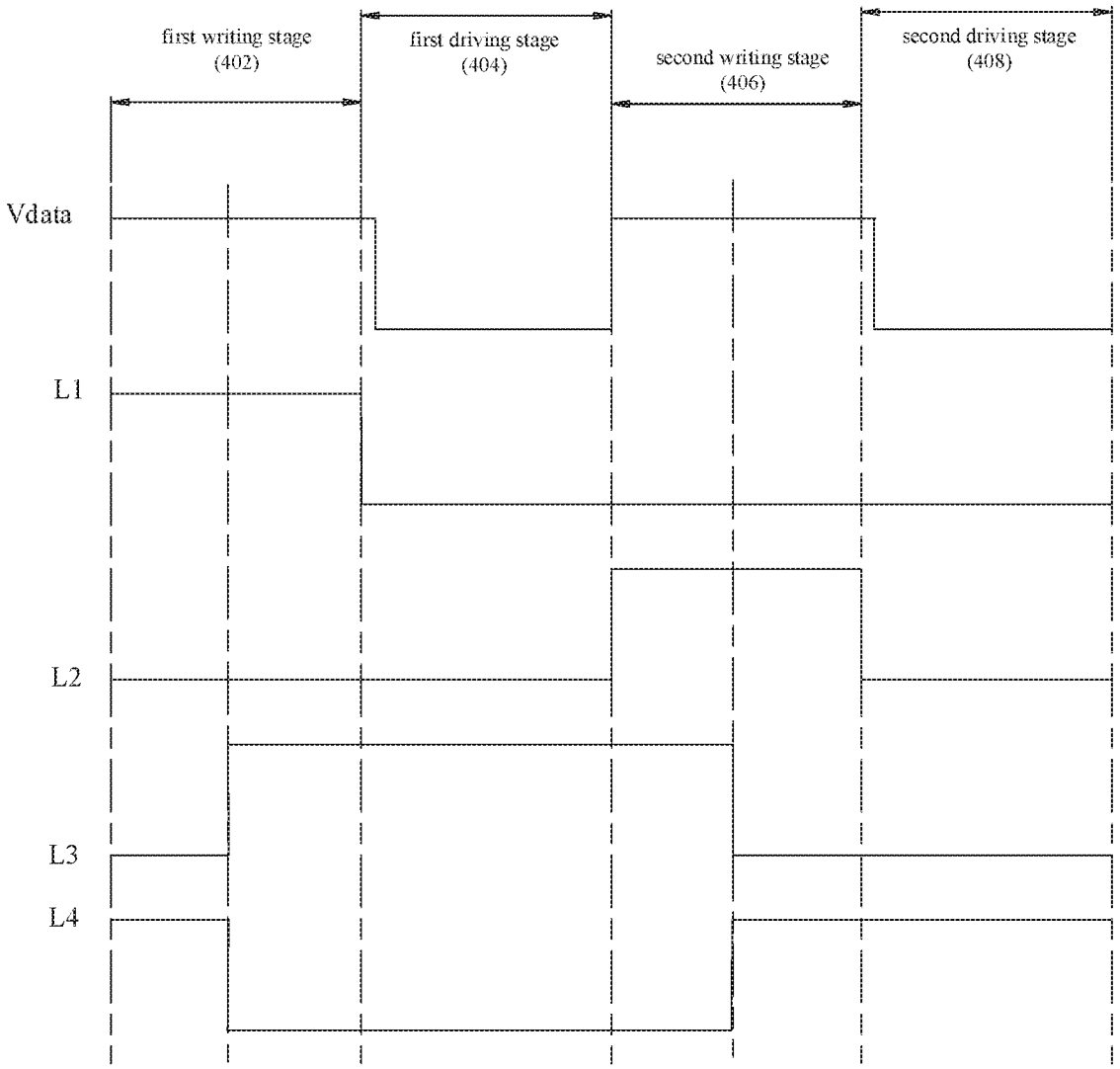
FIG. 4 is a timing diagram of a method for driving a pixel driving circuit according to an arrangement of the present disclosure.

FIG. 4 is a driving method for a pixel driving circuit according to an arrangement of the present disclosure. Referring to FIG. 4, a driving method for a pixel driving circuit according to an arrangement of the present disclosure includes the following blocks.

In a first writing stage (402), a high level signal is input to the first control terminal L1, the first data writing unit is in a conductive state, a data signal at the data terminal Vdata is transmitted to the first capacitor.

In a first driving stage (404), a high level signal to the third control terminal L3, the first switching unit is in a conductive state, a low high level signal is input to the fourth control terminal, the second switching unit in a non-conductive state, and the light emitting unit is driven by the first sub-driver unit to emit light.

In a second writing stage (406), inputting a high level signal to the second control terminal to make the second data writing unit in a conductive state, and to transmit the data signal at the data terminal to the second capacitor.

In a second driving stage (408), inputting a high level signal to the fourth control terminal to make the second switching unit in a conductive state, inputting a low level signal to the third control terminal to make the first switching unit in a non-conductive state, and driving the light emitting unit to emit light by the second sub-driver unit.

The first writing stage and the first driving stage may cause the first sub-driver unit to drive the light emitting unit to emit light; and the second writing stage and the second driving stage may cause the second sub-driver unit to drive the light emitting unit to emit light.

The first writing stage, the first driving stage, the second writing stage, and the second driving stage are executed sequentially and cyclically, thus implementing the alternating driving of the light emitting unit by the first sub-driver unit and the second sub-driver unit. The present disclosure can reduce the time for a single driver unit to drive the light emitting unit as compared with the prior art. Thus, the present disclosure can reduce the drift in threshold voltage of each driver unit, and can improve the stability of the brightness of the light emitting unit.

In the pixel driving circuit provided in this arrangement, charging and discharging units providing voltage compensation to the storage capacitor unit are configured, so that driver unit can continuously output the required current accurately, thus realizing high-quality bright display.

Referring to FIG. 3, a pixel driving circuit according to an arrangement of the present disclosure further provides charging and discharging units providing voltage compensation for the storage capacitor unit based on the pixel driving circuit provided in the above arrangement. As shown in FIG. 3, the pixel driving circuit further includes a first charging unit 61 and a first discharging unit 62. The first charging unit 61 has a first charging switch, two terminals of the first charging switch are connected to a charging circuit (or a charging line) and the first terminal of the first capacitor 41, respectively. The first discharging unit 62 has a first discharging switch, and two terminals of the first discharging switch are connected to a discharging circuit (or a discharging line) and the second terminal of the first capacitor 41.

During the continuous operation of the first sub-driver unit, a threshold voltage drift may occur, which affects the brightness of the light emitting unit. In this arrangement, the first capacitor may be compensated by the following blocks.

In the second write stage:

In a charging block, the first charging unit and the first discharging unit are turned on, so that the charging circuit charges the first capacitor to make the voltage across the first capacitor to be vdd.

In a discharge block, the charging circuit is turned off, and the first capacitor is discharged through the first discharging unit, so that the voltage across the first capacitor is decreased to the threshold voltage V3*th* of the first sub-driver unit.

In the second drive stage:

The voltage across the first capacitor is maintained at V3*th* by turning off the first charging unit and the first discharging unit.

Loop is performed again to the first write stage:

A high level signal is input to the first control terminal, the first data writing unit is in a conductive state, the data signal Vdata at the data terminal is transmitted to the first capacitor, and the voltage across the first capacitor rises to Vdata+ V3*th*.

In the first driving stage:

In the driving block, a high level signal is input to the third control terminal, and a low level signal is input to the fourth control terminal, and at this time, since the relationship between the saturated output current of the first sub-driver unit and the gate voltage of the first sub-driver unit is $$IDS = \frac{1}{2}\frac{W}{L}C\mu(VG - V3th)^2,$$

as the threshold voltage of the first sub-driver unit continuously is drifted, due to the existence of the logic circuit, the first sub-driver unit has a stable output signal under the condition of the data signal Vdata That is, $$IDS = \frac{1}{2}\frac{W}{L}C\mu Vdata^2$$

is always established, and the first sub-driver unit can continue to output a stable saturated output current in the case where the threshold voltage of the sub-driver unit is drifted.

In the driving control of the pixel driving circuit, it is generally required to configure associated signal lines. The specific signal lines are arranged as follows. The gate of the first charging unit 61 is connected to the second control terminal L2, the first electrode of the first charging unit 61 is connected to the first electrode of the first switching unit 51, and the second electrode of the first charging unit 61 is connected to the first electrode of the first capacitor 41. The gate of the first discharging unit 62 is connected to the second control terminal L2, the first electrode of the discharging unit 62 is connected to the second electrode of the first capacitor 41, and the second electrode of the first discharging unit 62 is connected to a common ground electrode Gnd.

In the driving method of the pixel driving circuit provided by the above arrangement, as shown in FIG. 4, the second writing stage specifically includes the following blocks.

A high level signal is input to the second control terminal L2, and at the same time, a high level signal is input to the third control terminal L3, the second data writing unit is in a conductive state, and the data signal at the data terminal Vdata is transmitted to the first capacitor. The first charging unit is in a conductive state, the first discharging unit is in a conductive state, and the first switching unit is in a conductive state to charge the first capacitor.

A high level signal is input to the fourth control terminal L4, a low level signal is input to the third control terminal L3, the first switching unit is in a non-conductive state to discharge the first capacitor, so that the voltage across the first electrode and the second electrode of the first capacitor is decreased to the threshold voltage of the first sub-driver unit. The specific time for discharging the first capacitor depends on the type of the different capacitors, for example, 1-10 microseconds.

The second driving stage specifically includes the following blocks.

A high level signal is input to the fourth control terminal L4, the second switching unit is in a conductive state, a low level signal is input to the third control terminal L3, and the first switching unit is in a non-conductive state, so that the second sub-driver unit drives the light emitting unit to emit light. A low level signal is input to the second control terminal L2, the first charging unit is in a non-conductive state, and the first discharging unit is in a non-conductive state.

In the circuit control, the second control unit can simultaneously control the conductive state and the non-conductive state of the second data writing unit, the first charging unit, and the first discharging unit, thus reducing the number of control circuits and facilitating control.

Similarly to the idea of the above arrangement in which the first charging and discharging units are provided for making compensation to the first capacitor, on the basis of the above arrangement, a second charging unit and a second discharging making compensation to the first capacitor may be added. As shown in FIG. 3, the pixel driving circuit further includes a second charging unit 71 and a second discharging unit 72. The second charging unit 71 has a second charging switch, two terminals of the second charging switch are connected to the charging circuit and the first terminal of the second capacitor 42, respectively. The second discharging unit 72 has a second discharging switch, two terminals of the second discharging switch are connected to the discharging circuit and the second terminal of the second capacitor 42, respectively.

During the continuous operation of the second sub-driver unit, a threshold voltage drift may occur, which affects the luminance of the light emitting unit. In this arrangement, the second capacitor may be compensated by the following blocks:

In the first writing stage:

In a charging block, the second charging unit and the second discharging unit are turned on, so that the charging circuit charges the second capacitor to make the voltage across the second capacitor to be vdd.

In a discharging block, the charging circuit is turned off, and the second capacitor is discharged through the second discharging unit to make the voltage across the second capacitor to be decreased to the threshold voltage V3*th* of the second sub-driver unit.

In the first driving stage: the second charging unit and the second discharging unit are turned off, so that the voltage across the second capacitor is maintained at V3*th*.

In the second writing stage: a high level signal is input to the second control terminal, the second data writing unit is in a conductive state, and the data signal Vdata at the data terminal is transmitted to the second capacitor, and the voltage across the second capacitor rises to Vdata+V3*th*.

In the second driving stage:

In the driving block, a high level signal is input to the fourth control terminal, and a low level signal is input to the third control terminal; at this time, since the relationship between the saturated output current of the second sub-driver unit and the gate voltage of the second sub-driver unit is $$IDS = \frac{1}{2}\frac{W}{L}C\mu(VG - V3th)^2,$$

as the threshold voltage of the second sub-driver unit is continuously drifted, due to the existence of the logic circuit, the second sub-driver unit has a stable output signal under the condition of the data signal Vdata voltage. That is, $$IDS = \frac{1}{2}\frac{W}{L}C\mu Vdata^2$$

is always established, and the second sub-driver unit can continuously output a stable saturated output current even in the case where there is a drift in the threshold voltage of the second sub-driver unit.

In the driving control of the pixel driving circuit, it is generally required to configure associated signal lines. The specific signal line arrangement is as follows. The gate of the second charging unit 71 is connected to the first control terminal L1, the first electrode of the second charging unit 71 is connected to the first electrode of the second switching unit 52, and the second electrode of the second charging unit 71 is connected to the first electrode of the second capacitor 42. The gate of the second discharging unit 72 is connected to the first control terminal L1, the first electrode of the second discharging unit 72 is connected to the second electrode of the second capacitor 42, and the second electrode of the second discharging unit 42 is connected to the common ground electrode Gnd.

In the driving method of the pixel driving circuit provided by the above arrangement, as shown in FIG. 4, the first writing stage specifically includes the following blocks.

A high level signal is input to the first control terminal L1, and at the same time, a high level signal is input to the fourth control terminal L4, the first data writing unit is in a conductive state, and the data signal Vdata at the data terminal is transmitted to the first capacitor; the second charging unit is in a conductive state, the second discharging unit is in a conductive state, and the second switching unit is in a conductive state to charge the second capacitor.

A high level signal is input to the third control terminal L3, a low level signal is input to the fourth control terminal L4, the second switching unit is in a non-conductive state to discharge the second capacitor, so that the voltage across the first electrode and the second electrode of the second capacitor is decreased to the threshold voltage of the second sub-driver unit. The specific time for discharging the first capacitor depends on the type of different capacitors, for example, 1-10 microseconds.

The first driving stage specifically includes the following blocks.

A high level signal is input to the third control terminal L3, the first switching unit is in a conductive state, a low level signal is input to the fourth control terminal L4, and the second switching unit is in a non-conductive state, so that the first sub-driver unit drives the light emitting unit to emit light. A low level signal is input to the first control terminal L1, the second charging unit is in a non-conductive state, and the second discharging unit is in a non-conductive state.

In the circuit control, the first control unit can simultaneously control the conductive state and the non-conductive state of the first data writing unit, the second charging unit, and the second discharging unit, thus reducing the number of control circuits and facilitating control.

As shown in FIG. 2, the first charging unit M2, the first discharging unit M6, the second charging unit M8, and the second discharging unit M7 may each be a thin film transistor.

Based on the inventive concept of the pixel driving circuit in the above arrangements, an array substrate according to an arrangement of the present disclosure includes: a pixel driving circuit. The pixel driving circuit includes any one of the pixel driving circuits of the above arrangements.

The array substrate of the arrangement is configured with a dual driver unit, that is, two driver units can alternately drive the light emitting unit. Thus, the array substrate can reduce the drift in threshold voltage of each driver unit, and can improve the stability of the brightness of the light emitting unit.

Based on the inventive concept of the pixel driving circuit in the above arrangement, a display panel according to an arrangement of the present disclosure includes an array substrate. The array substrate includes the array substrate in the above arrangement.

Based on the inventive concept of the pixel driving circuit in the above arrangement, a display device according to an arrangement of the present disclosure includes a display panel. The display panel includes the display panel in the above arrangement.

The display device may be any product or component having a display function such as a display panel, an electronic paper, a mobile phone, a tablet computer, a television, a display, a notebook computer, a digital photo frame, a navigator, and the like.

In the display device provided by the arrangements of the present disclosure, the pixel driving circuit has a dual driver unit structure, that is, the first sub-driver unit and the second sub-driver unit can alternately drive the light emitting unit, which can reduce the time for a single driver unit to drive the light emitting unit as compared with the prior art. Thus, the present disclosure can reduce the drift in threshold voltage of each driver unit, and can improve the stability of the brightness of the light emitting unit.

In the above arrangements, the descriptions of the various arrangements have difference focuses, and the parts that are not detailed in a certain arrangement can be found in related descriptions of other arrangements.

It will be appreciated that related features in the above described devices may be referenced to each other. In addition, "first", "second", and the like in the above arrangements are used to distinguish the arrangements, and do not represent the advantages and disadvantages of the arrangements.

In the description provided herein, numerous specific details are set forth. However, it should be understood that the arrangements of the present disclosure may be practiced without these specific details. In some instances, well-known structures and techniques are not shown in detail so as not to obscure the description.

It should be understood that, in order to simplify the description of the present disclosure and facilitate understanding of one or more aspects of the present disclosure, in the descriptions regarding exemplary arrangements, features of arrangements are grouped into a single arrangement, a single drawing or descriptions regarding one arrangement. However, the separately described devices of the present disclosure are intended to be constructed as follows: the disclosure which is sought to be protected encompasses features more than that described in the descriptions. To be clear, as defined by the appended claims, the inventive aspects include features less than all of the features as disclosed regarding a single arrangement. Thus, the claims based on the specific arrangements are incorporated into the specific arrangements and each claim itself can serve as a single arrangement.

Those skilled in the art will appreciate that the components of the devices in the arrangements can be adaptively changed and placed in one or more different devices than the arrangements. The components of an arrangement can be combined into one component and, in addition, they can be divided into a plurality of sub-components. All of the features disclosed in this specification, including the accompanying claims, the abstract and the drawings, and all components of any device so disclosed may be combined, unless such the features or components conflict with each other. Each feature disclosed in the specification, including the accompanying claims, the abstract and the drawings, may be replaced by alternative features that provide the same, equivalent or similar purpose.

In addition, those skilled in the art will appreciate that although some arrangements described herein include certain features that are included in other arrangements and not other features, combinations of features of different arrangements are within the scope of the present disclosure, and can form different arrangements. For example, in the following claims, any one of the arrangements can be used in any combination. The various device or apparatus arrangements of the present disclosure may be implemented in hardware or in a combination thereof.

It is to be noted that the above-described arrangements are illustrative of the present disclosure and are not intended to limit the scope of the present disclosure, and those skilled in the art can devise alternative arrangements without departing from the scope of the appended claims. In the claims, any reference signs placed between parentheses shall not be construed as a limitation. The word "comprising" or "including" does not exclude the presence of a component or component that is not listed in the claims. The word "a" or "an" preceding a component does not exclude the presence of a plurality of such components. The present disclosure can be implemented by means of a device including several distinct components. In the claims enumerating several components, several of these components may be embodied by the same component item. The use of the words first, second, and third does not indicate any order. These words can be interpreted as names.

The above is only description regarding exemplary arrangements of the present disclosure, and is not intended to limit the present disclosure in any way. Any simple modifications, equivalent changes and variations made to the above arrangements in accordance with the technical spirit of the present disclosure fall within the scope of the present disclosure.

What is claimed is:

1. A pixel driving circuit comprising: a driver unit; a circuit switching unit; and a storage capacitor unit, wherein:

the driver unit comprises a first sub-driver unit and a second sub-driver unit and;

the circuit switching unit has a first switching unit and a second switching unit, wherein two terminals of the first switching unit are electrically connected to a first terminal of a light emitting unit and the first sub-driver unit, respectively; two terminals of the second switching unit are electrically connected to the light emitting unit and the second sub-driver unit, respectively; and the circuit switching unit is configured to switch conductive states of the first switching unit and the second switching unit, wherein:

the pixel driving circuit further comprises a switching unit;

the storage capacitor unit comprises a first capacitor and a second capacitor;

the switching unit comprises a first data writing unit and a second data writing unit;

the first data writing unit and a gate of the first sub-driver unit are connected via the first capacitor; and the second data writing unit and a gate of the second sub-driver unit are connected via the second capacitor, wherein the pixel driving circuit n comprises:

a data terminal connected to a first electrode of the first data writing unit and a first electrode of the second data writing unit;

a first control terminal connected to a gate of the first data writing unit;

a second control terminal connected to a gate of the second data writing unit;

a third control terminal connected to a gate of the first switching unit;

a fourth control terminal connected to a gate of the second switching unit;

a first level signal input terminal connected to a second terminal of the light emitting unit; and a second level signal input terminal connected to a first electrode of the first sub-driver unit and a first electrode of the second sub-driver unit, wherein: a second electrode of the first sub-driver unit is connected to a first electrode of the first switching unit; a second electrode of the second sub-driver unit is connected to a first electrode of the second switching unit; a second electrode of the first switching unit is connected to the first terminal of the light emitting unit; and a second electrode of the second switching unit is connected to the first terminal of the light emitting unit, wherein the pixel driving circuit further comprises a first charging unit and a first discharging unit, and wherein:

the first charging unit has a first charging switch, and two terminals of the first charging switch are connected to a charging circuit and a first terminal of the first capacitor, respectively; and the first discharging unit has a first discharging switch, and two terminals of the first discharging switch are connected to a discharging circuit and a second terminal of the first capacitor.

2. The pixel driving circuit according to claim 1, wherein the first sub-driver unit and the second sub-driver unit are thin film transistors.

3. The pixel driving circuit according to claim 1, wherein:

a gate of the first charging unit is connected to the second control terminal, a first electrode of the first charging unit is connected to the first electrode of the first switching unit, and a second electrode of the first charging unit is connected to the first terminal of the first capacitor; and a gate of the first discharging unit is connected to the second control terminal, a first electrode of the first discharging unit is connected to a second terminal of the first capacitor, and a second electrode of the first discharging unit is connected to a common ground.

4. The pixel driving circuit according to claim 1, further comprising a second charging unit and a second discharging unit, wherein:

the second charging unit has a second charging switch, and two terminals of the second charging switch are connected to a charging circuit and a first terminal of the second capacitor, respectively; and the second discharging unit has a second discharging switch, and two terminals of the second discharging switch are connected to a discharging circuit and a second terminal of the second capacitor.

5. The pixel driving circuit according to claim 4, wherein:

a gate of the second charging unit is connected to the first control terminal, a first electrode of the second charging unit is connected to the first electrode of the second switching unit, and a second electrode of the second charging unit is connected to a first terminal of the second capacitor; and a gate of the second discharging unit is connected to the first control terminal, a first electrode of the second discharging unit is connected to a second terminal of the second capacitor, and a second electrode of the second discharging unit is connected to a common ground.

6. The pixel driving circuit according to claim 1, wherein the first sub-driver unit and the second sub-driver unit are P-type thin film transistors, a signal input to the first level signal input terminal is a high level signal, and a signal input to the second level signal input terminal is a low level signal.

7. A driving method for the pixel driving circuit according to claim 1, comprising:

in a first writing stage, inputting a high level signal to the first control terminal to make the first data writing unit in a conductive state, and to transmit a data signal at the data terminal to the first capacitor;

in a first driving stage, inputting a high level signal to the third control terminal to make the first switching unit in a conductive state, inputting a low high level signal to the fourth control terminal to make the second switching unit in a non-conductive state, and driving the light emitting unit to emit light by the first sub-driver unit;

in a second writing stage, inputting a high level signal to the second control terminal to make the second data writing unit in a conductive state, and to transmit the data signal at the data terminal to the second capacitor; and in a second driving stage, inputting a high level signal to the fourth control terminal to make the second switching unit in a conductive state, inputting a low level signal to the third control terminal to make the first switching unit in a non-conductive state, and driving the light emitting unit to emit light by the second sub-driver unit.

8. The method according to claim 7, wherein:

a gate of the first charging unit is connected to the second control terminal, a first electrode of the first charging unit is connected to the first electrode of the first switching unit, and a second electrode of the first charging unit is connected to the first terminal of the first capacitor; and a gate of the first discharging unit is connected to the second control terminal, a first electrode of the first discharging unit is connected to a second terminal of the first capacitor, and a second electrode of the first discharging unit is connected to a common ground, and wherein, in the second writing stage, the method further comprises:

inputting a high level signal to the second control terminal, and at the same time inputting a high level signal to the third control terminal to make the first charging unit in a conductive state and the first discharging unit in a conductive state and to charge the first capacitor; and inputting a low level signal to the third control terminal to make the first switching unit in a non-conductive state to discharge the first capacitor until a voltage across the first and second terminals of the first capacitor is dropped to a threshold voltage of the first sub-driver unit, and wherein, in the second driving stage, the method further comprises:

inputting a low level signal to the second control terminal to make the first charging unit in a non-conductive state and the first discharging unit in a non-conductive state.

9. The method according to claim 7, wherein the pixel driver unit further comprises a second charging unit and a second discharging unit, wherein:

the second charging unit has a second charging switch, and two terminals of the second charging switch are connected to a charging circuit and a first terminal of the second capacitor, respectively;

the second discharging unit has a second discharging switch, and two terminals of the second discharging switch are connected to a discharging circuit and a second terminal of the second capacitor;

a gate of the second charging unit is connected to the first control terminal, a first electrode of the second charging unit is connected to the first electrode of the second switching unit, and a second electrode of the second charging unit is connected to a first terminal of the second capacitor; and a gate of the second discharging unit is connected to the first control terminal, a first electrode of the second discharging unit is connected to a second terminal of the second capacitor, and a second electrode of the second discharging unit is connected to a common ground, wherein, in the first writing stage, the method further comprises:

inputting a high level signal to the first control terminal, and at the same time inputting a high level signal to the fourth control terminal to make the second charging unit in a conductive state, the second discharging unit in a conductive state and the second switching unit in a conductive state to charge the second capacitor; and inputting a low level signal to the fourth control terminal to make the second switching unit in a non-conductive state to discharge the second capacitor, until a voltage across first and second terminals of the second capacitor is dropped to a threshold voltage of the second sub-driver unit, and wherein, in the first driving stage, the method further comprises:

inputting a low level signal to the first control terminal to make the second charging unit in a non-conductive state and the second discharging unit in a non-conductive state.

10. The method according to claim 7, wherein the first writing stage, the first driving stage, the second writing stage and the second driving stage are performed sequentially and cyclically.

11. An array substrate, comprising: a pixel driving circuit, wherein the pixel driving circuit comprises a light emitting unit, a driver unit, a circuit switching unit, and a storage capacitor unit, wherein:

the driver unit comprises a first sub-driver unit and a second sub-driver unit; and the circuit switching unit has a first switching unit and a second switching unit, wherein two terminals of the first switching unit are electrically connected to a first terminal of the light emitting unit and the first sub-driver unit, respectively; two terminals of the second switching unit are electrically connected to the light emitting unit and the second sub-driver unit, respectively; and the circuit switching unit is configured to switch conductive states of the first switching unit and the second switching unit, wherein:

the pixel driving circuit further comprises a switching unit;

the storage capacitor unit comprises a first capacitor and a second capacitor;

the switching unit comprises a first data writing unit and a second data writing unit;

the first data writing unit and a gate of the first sub-driver unit are connected via the first capacitor; and the second data writing unit and a gate of the second sub-driver unit are connected via the second capacitor, wherein the pixel driving circuit comprises:

a data terminal connected to a first electrode of the first data writing unit and a first electrode of the second data writing unit;

a first control terminal connected to a gate of the first data writing unit;

a second control terminal connected to a gate of the second data writing unit;

a third control terminal connected to a gate of the first switching unit;

a fourth control terminal connected to a gate of the second switching unit;

a first level signal input terminal connected to a second terminal of the light emitting unit; and a second level signal input terminal connected to a first electrode of the first sub-driver unit and a first electrode of the second sub-driver unit, wherein: a second electrode of the first sub-driver unit is connected to a first electrode of the first switching unit; a second electrode of the second sub-driver unit is connected to a first electrode of the second switching unit; a second electrode of the first switching unit is connected to the first terminal of the light emitting unit; and a second electrode of the second switching unit is connected to the first terminal of the light emitting unit, wherein the pixel driving circuit further comprises a first charging unit and a first discharging unit, and wherein:

the first charging unit has a first charging switch, and two terminals of the first charging switch are connected to a charging circuit and a first terminal of the first capacitor, respectively; and the first discharging unit has a first discharging switch, and two terminals of the first discharging switch are connected to a discharging circuit and a second terminal of the first capacitor.

12. A display panel, comprising the array substrate according to claim 11.

* * * * *